United States Patent [19]

DiStefano

[11] Patent Number: 4,859,527

[45] Date of Patent: Aug. 22, 1989

[54] CELLULOSIC NONWOVEN PRODUCTS OF ENHANCED WATER AND/OR SOLVENT RESISTANCE BY PRETREATMENT OF THE CELLULOSIC FIBERS

[75] Inventor: Frank V. DiStefano, Macungie, Pa.

[73] Assignee: Air Products and Chemicals, Inc., Allentown, Pa.

[21] Appl. No.: 869,141

[22] Filed: May 29, 1986

[51] Int. Cl.[4] ..... B05D 3/00; B32B 9/06; B32B 27/04; B32B 27/12

[52] U.S. Cl. ..... 428/288; 2/2; 2/243 A; 15/209 R; 162/135; 162/136; 128/849; 427/324; 427/389.9; 427/392; 427/411; 427/412; 428/290; 604/365; 604/375

[58] Field of Search ..... 428/288, 290, 342; 427/324, 389.9, 392, 412, 411; 162/135, 136

[56] References Cited

U.S. PATENT DOCUMENTS

| | | | |
|---|---|---|---|
| 2,601,597 | 6/1952 | Daniel, Jr. et al. | 92/21 |
| 3,049,469 | 8/1962 | Davison | 162/164 |
| 3,320,066 | 5/1967 | Garth | 96/85 |
| 3,380,851 | 4/1968 | Lindemann et al. | 117/140 |
| 3,594,210 | 7/1971 | Drelich | 117/38 |
| 4,291,087 | 9/1981 | Warburton, Jr. | 428/288 |
| 4,332,850 | 6/1982 | Iacoviello | 428/288 |
| 4,413,032 | 11/1983 | Hartmann et al. | 428/288 |
| 4,481,250 | 11/1984 | Cook et al. | 428/288 X |
| 4,505,775 | 3/1985 | Harding et al. | 162/9 |
| 4,600,462 | 7/1986 | Watt | 428/288 X |
| 4,605,589 | 8/1986 | Orphanides | 428/288 X |

FOREIGN PATENT DOCUMENTS

| | | |
|---|---|---|
| 0071392 | 2/1983 | European Pat. Off. . |
| 1306296 | 9/1962 | France . |
| 2045860 | 3/1971 | France . |
| 1163842 | 9/1969 | United Kingdom . |
| 1281014 | 7/1972 | United Kingdom . |

OTHER PUBLICATIONS

1983 Papermakers Conf. Journal–"-Poly(Aminoamide)-Epichlorohydrin Resin-Carboxymethylcellulose Combinations for Wet and Dry Strength In Paper", H. H. Epsy, pp. 191–195.

*Primary Examiner*—James C. Cannon

*Attorney, Agent, or Firm*—Leach, Michael; William F. Marsh; James C. Simmons

[57] ABSTRACT

In a method for bonding a nonwoven web of cellulosic fibers by depositing a polymeric binder on the web, the improvement comprising (1) pretreating the cellulosic fibers by depositing up to about 10 wt % of an adhesion-promoting compound which demonstrates adhesion to cellulosic fibers of at least 200 g as measured by a cellophane laminate test, and (2) depositing on the pretreated cellulosic fibers and amount of an overcoat binder polymer sufficient to provide a bonded self-sustaining web.

20 Claims, 1 Drawing Sheet

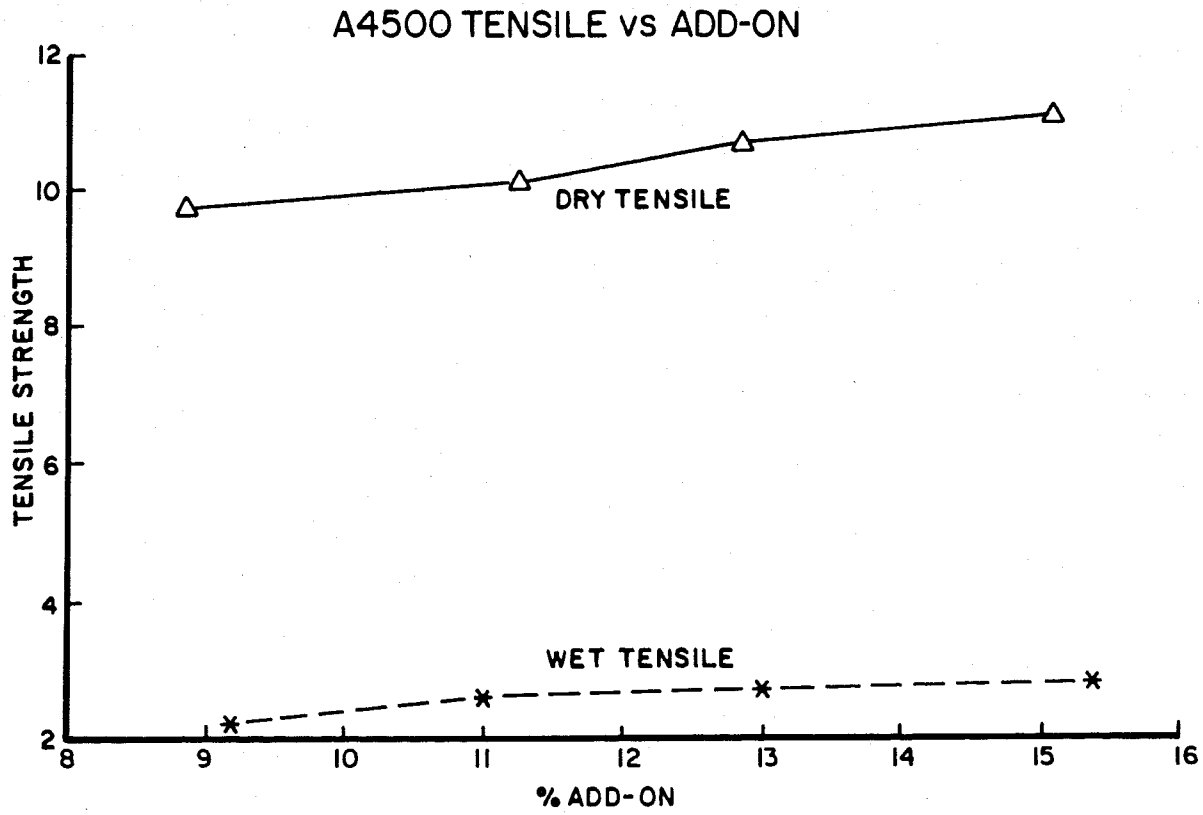
A4500 TENSILE VS ADD-ON
DRY TENSILE
WET TENSILE
TENSILE STRENGTH
% ADD-ON
12
10
8
6
4
2
8
9
10
11
12
13
14
15
16

CELLULOSIC NONWOVEN PRODUCTS OF ENHANCED WATER AND/OR SOLVENT RESISTANCE BY PRETREATMENT OF THE CELLULOSIC FIBERS

TECHNICAL FIELD

This invention relates to nonwoven products comprising cellulosic fibers bonded together with a binder resin.

BACKGROUND OF THE INVENTION

Nonwoven products comprise loosely assembled webs or masses of fibers bound together with an adhesive binder. Adequately bonded nonwoven fabrics have advantages over woven fabrics for a large variety of uses. It is known to form bonded nonwoven fabrics by impregnating, printing or otherwise depositing an adhesive bonding composition on a base web of fibers. These fibers may be of cellulosic or polymer maerials such as wood pulp, polyester, polyamides, polyacrylates and the like. The base web of nonwoven fibers to which the binder is applied can be produced by carding, garnetting, air-laying, wet-laying, paper making procedures, or other known operations.

The polymeric binder must imbue the bonded nonwoven product with acceptable dry and wet tensile strengths and solvent resistance for the intended application.

One of the more successful copolymer binder compositions for nonwoven products comprises a vinyl acetate/ethylene/N-methylolacrylamide copolymer. (See U.S. Pat. No. 3,380,851). However, such N-methylolacrylamide (NMA) containing copolymers liberate formaldehyde during cure and subsequent use of the nonwoven.

The nonwovens industry seeks binders yielding ever increasing improvements in water and solvent resistance. In many instances, the nonwoven manufacturer is also demanding that these binders be free of formaldehyde. There are few products that meet both of these requirements.

To improve the water and solvent resistance, i.e. chemical resistance, of a binder, the chemist normally resorts to increasing crosslink density. Unfortunately, the crosslinking monomers most commonly employed contain formaldehyde. In general, the formaldehyde-free crosslinking systems do not offer the high degree of chemical resistance that those containing formaldehyde do.

U.S. Pat. No. 4,505,775 discloses a fibrous, cationic cellulose pulp product and the method of preparing it. A cationic cellulose is made by reaction, under mildly alkaline aqueous conditions, of cellulose fibers with one of a group of condensates based on the reaction product of epichlorohydrin and dimethylamine.

SUMMARY OF THE INVENTION

The invention provides an improvement in the method for bonding a nonwoven web of cellulosic fibers by depositing a polymeric binder on the web. The improved method comprises (1) pretreating the cellulosic fibers by depositing up to about 10 wt% of an adhesion promoting compound which demonstrates adhesion to cellulose of at least 200 g as measured by a cellophane laminate test, and (2) depositing on the pretreated cellulosic fibers an amount of a particular binder polymer sufficient to provide a self-sustaining web. The particular binder polymer is one which demonstrates wet tensile strength on Whatman #4 filter paper at 10% add-on (TAPPI Useful Method 656) of less than 3 pli and a swell value of less than 100% using the boiling water test, or a methylethyl ketone (MEK) tensile strength on Whatman #4 filter paper at 10% add-on (TAPPI Useful Method 656) of less than 4 pli and an MEK swell index of less than 5. Such binder polymers are referred to as "overcoat binder polymer" for purposes of describing the invention. As another embodiment of the invention, there is provided a nonwoven product comprising a nonwoven web of cellulosic fibers bonded together with a binder adhesive, the cellulosic fibers having at a first coat up to 10% wt% of an adhesion promoting compound which demonstrates adhesion of at least 200 g to cellulosic fibers as measured by the cellophane laminate test and upon such first coat a sufficient amount, preferably 3 to 100 wt%, especially 5–50 wt%, of an overcoat binder polymer to afford a self-substaining nonwoven web.

The invention provides a cellulosic nonwoven product having surprisingly greater water and/or solvent resistance from the use of a particular binder, in many instances doing so without the potential for liberating formaldehyde.

Products whose performance can be improved through the use of this invention include paper towels, industrial wipes, protective garments, medical/surgical materials and the like.

The method of the invention can be applied by any nonwoven bonding process currently using a binder where there exists a suitable method of pretreating the cellulosic fibers.

BRIEF DESCRIPTION OF THE DRAWING

The sole drawing is a graphic presentation of the wet and dry tensile strengths of an emulsion copolymer at several add-on amounts.

DETAILED DESCRIPTION OF THE INVENTION

In general, the invention comprises depositing a pretreatment, adhesion promoting agent on cellulosic fibers that compose the nonwoven web in a bonded nonwoven product. This desposition can be most conveniently performed in an aqueous cellulosoc fiber slurry prior to formation of the web; for example, the pulp fiber supplier to the nonwovens manufacture could perform the pretreatment. However, the deposition may also be performed on a cellulosic fibrous web or sheet by saturating with the pretreatment agent. If the treated cellulosic fibers are not already in the form of a consolidated sheet, this can be achieved, for example, using wet-laid or air-laid papermaking technology. The binder polymer is then applied to the treated cellulosic fibers is currently practiced in the air-laid and wet-laid papermaking processes.

Although fiber pretreatments are common in industry, they are normally used with low surface energy, hydrophobic fibers, such as polyesters, polyamides, and polypropylene, to improve wetting and processing. The present invention uses a pretreatment for cellulosic fibers, which have a high surface energy, and, specifically, a pretreatment to enhance nonwoven binder efficiency. Specifically, the method comprises (1) depositing on the cellulosic fibers as a first coat up to about 10wt% of an adhesion-promoting compound, e.g. a polymer, which most likely will contain polar functionality, such as amino, amido and hydroxyl functionality, and demonstrates adhesion to cellulosic fibers of at least 200 g, preferably at least 400 g as measured by the cellophane laminate test, and (2) depositing on the pretreated cellulosic fibers a sufficient amount, preferably 3 to 100 wt%, of an overcoat binder polymer to provide a self-sustaining nonwoven web. The overcoat binder polymer demonstrates wet tensile strength on Whatman #4 filter paper at 10% add-on (using TAPPI Useful Method 656) of less than 3 pli, desirably less than 2.5 pli, and a swell value of less than 100%, desirably less than 50% using the boiling water test, or an MEK tensile strength on Whatman #4 filter paper of less than 4 pli, desirably less than 3 pli and an MEK swell index of less than 5, desirably less than 3.

Illustrative of suitable pretreatment agents are polyethylenimines, polypropylenimines, polyfunctional aziridine compounds, poly(aminoamide)epichlorohydrin resins, polydiallylamines, vinyl acetate-ethylene-N-methylolacrylamide (VAE/NMA) copolymers, polydimethylaminoethylmethacrylate, Rhoplex HA-8 acrylic copolymer, Hycar 2600X347 acrylic copolymer, polyvinylamine and Fibrabon 33 and Fibrabon 35 wet strength agents. Other suitable materials would include compounds, for example oligomeric or polymeric compounds, containing amine, amide, hydroxyl or other polar functionality. Such pretreatment agents can be used at up to about 10 wt%, preferably 0.1 to 5 wt%, based on cellulosic fibers. At above about 10 wt% of pretreating agent the nonwoven product may become undesirably stiff.

Representative of suitable overcoat binders that can be applied to the pretreated cellulosic fibers are ethylene-vinyl chloride-acrylamide polymers, ethylene-acrylic acid copolymers, vinylidene chloride copolymers, ethylacrylate-vinyl acetate-methacrylic acid copolymers and vinyl chloride-butylacrylate copolymers. Other suitable materials would include polyneoprenes, butadine-acrylonitrile copolymers, polyurethanes, styrene-acrylate copolymers, vinyl acetate-acrylate copolymers and vinyl chloride-acrylate copolymers. In general, a sufficient amount of such overcoat polymer binder is used to provide a self-sustaining nonwoven web of cellulosic fibers. Suitable the binder would constitute 3 to 100 wt%, preferably 5 to 50 wt%, based on fiber weight, of the nonwoven product.

It has been found that many of the binders which exhibited excellent cohesive strength in water and solvent lacked adhesion to cellulosic fibers resulting in the binder being ineffective in improving the wet and solvent resistance of the bonded nonwoven web.

Through the use of adhesion-promoting pretreatments, the intrinsic strength of these emulsion binders can be translated to the bonded web.

The method by which the pretreatment agent is applied to the cellulosic fibers is not critical. It can be accomplished by adding the pretreatment agent, possibly in aqueous solution, to an aqueous slurry of the cellulosic fibers or the preformed loosely assembled web of fibers can be impregnated with the pretreatment agent by spraying, saturation, or other methods common to the art.

If the cellulosic fiber is not already in the form of a consolidated sheet as in the case where the pretreatment agent is added to an aqueous fiber slurry, the starting fiber layer or mass for the nonwoven product can be formed by any one of the conventional techniques for depositing or arranging fibers in a web or layer. These techniques include carding, garnetting, air-laying, wet-laying and the like. Individual webs or thin layers formed by one or more of these techniques can also be laminated to provide a thicker layer for conversion into a fabric. Typically, the fibers extend in a plurality of diverse directions in general alignment with the major plane of the fabric, overlapping, intersecting and supporting one another to form an open, porous structure.

When reference is made to "cellulosic" fibers, those fibers containing predominantly $C_6H_{10}O_5$ groupings are meant. Thus, examples of the fibers to be used in the starting layer are the natural cellulose fibers such as wood pulp, cotton and hemp and the synthetic cellulose fibers such as rayon and regenerated cellulose. Often the fiber starting layer contains at least 50% cellulose fibers whether they be natural or synthetic, or a combination thereof. In addition to the cellulose fibers the starting layer may comprise minor amounts of natural fibers such as wool, jute; artificial fibers such as cellulose acetate; synthetic fibers such as polyvinyl alcohol, polyamides, nylon, polyesters, acrylics, polyolefins, i.e. polyethylene, polyvinyl chloride, polyurethane, and the like, alone or in combination with one another.

The starting layer of pretreated fibers is subjected to at least one of the several types of bonding operations to anchor the individual fibers together to form a self-sustaining web. Some of the latter known methods of bonding are overall impregnation, spraying, or printing the web with intermittent or continuous straight or wavy lines or areas of binder extending generally transversely or diagonally across the web and additionally, if desired, along the web.

The amount of binder, calculated on a dry basis, applied to the starting web of pretreated fibers is that amount which is at least sufficient to bind the fibers together to form a self-sustaining web and suitably ranges from about 3 to about 100% or more by weight of the starting web, preferably from about 5 to about 50 wt% of the starting web. The impregnated web is then dried. Curing is not necessary to achieve the improved water and solvent resistance afforded by the invention. Thus, the nonwoven product is suitably dried by passing it through an air oven or the like and, optionally, then through a curing oven. Typical laboratory conditions would be drying at 150° to 200° F. (66°-93° C.) for 4 to 6 minutes, followed optionally by curing at 300°-310° F. (149°-154° C.) for 3 to 5 minutes or more. However,other time-temperature relationships can be employed as is well known in the art, shorter times at higher temperatures or longer times at lower temperatures being used.

The method for determining the adhesion of the various compounds and polymers to the cellulose fibers is a cellophane laminate test described as follows: The compounds or polymer is applied at either an aqueous solution or emulsion to plasticized cellophane film (Dupont K140204) in an amount of about 1 mil using a wire-wound rod. A second sheet of cellophane is then laminated to this while the coating is still wet. The laminate is allowed to dry at room temperature.

Alternatively, unplasticized cellophane (Dupont 134PUD0) may be used, particularly when the material to be tested does not dry between plasticized cellophane films. The unplasticized cellophane has the advantage of allowing the laminate to dry more rapidly, but impairs the bond strength measurement because it is very brittle.

The dried cellophane laminate is cut into 1×4 inch strips and a 180° peel test is performed at 0.5 in/min on an Instron tester.

Acceptable pretreatment agents yield bond strengths of greater than 200 g on plasticized cellophane, desirably greater than 400 g. The values may vary considerably for unplasticized cellophane.

This test also indicates which binders lack adhesion to cellulose and require a pretreatment for optimum performance.

The criteria for choosing a suitable overcoat binder are (1) good chemical resistance and (2) relatively poor adhesion to cellulose. Chemical resistance is tested in water and MEK. Polymer films approximately ⅛ inch in thickness are submerged in boiling water for one hour. The sample is removeved and excess water blotted off before weighing. After drying to constant weight, the percent water absorbed is calculated as follows:

$$\frac{\text{wt. after submersion} - \text{final dry wt.}}{\text{final dry weight}}$$

A similar test is performed in MEK but the sample is submerged for 24 hours at room temperature.

Acceptable overcoat binders have a wet tensile strength on Whatman #4 filter paper at 10% add-on (using TAPPI Useful Method 656) of less than 3 pli and a boiling water swell of less than 100% or an MEK tensile strength on Whatman #4 paper or less than 4 pli and an MEK swell index of less than 5.

EXAMPLE 1

This Example (Runs 1–30) demonstrates the use of various pretreatment agent/polymer binder combinations to obtain enhanced wet tensile strength. The pretreatment agent was applied by saturating Whatman #4 filter paper. The polymer emulsion binder was then applied by saturation of the dried, pretreated paper. Even though this method is inefficient due to poor fiber coverage by the pretreatment and its redissolution during binder application, wet strength improvements of 50 to 300% and over 1000% in Runs 17 and 18 (Table I) were achieved over the values obtained with the binder alone. It is believed that deposition of the pretreatment agent via an aqueous slurry of the fiber would yield better fiber coverage and higher efficiency.

The percent improvement was determined in a very conservative manner by comparing the strength of the binder/pretreatment system with that of the individual binder and the pretreatment agent. Since the web itself makes no contribution to tensile strength, percent improvement in the presence of the pretreatment was calculated by subtracting the sum of the individual pretreatment agent and binder tensile strengths from the tensile strength when the combination is used and dividing by the binder tensile strength.

Minor differences in binder add-on due to greater pick-up by the pretreated web have little or no effect on tensile strength as can be seen from FIG. 1 which shows grapically the wet and dry tensile strengths of Airflex 4500 ethylene-vinyl chloride emulsion copplymer at add-on amounts ranging from about 9% to about 15%. The increase in tensile strengths is small compared to the approximately 60% increase in copolymer binder amount over the range.

TABLE I

| | | WET TENSILE STRENGTH (pli) | | | | | | |
|---|---|---|---|---|---|---|---|---|
| | | PRETREATMENT | | BINDER | | BINDER/ PRETREATMENT | | PERCENT |
| RUN | BINDER/PRETREATMENT* | ALONE | (wt %) | ALONE | (wt %) | (wt %/wt %) | | IMPROVEMENT |
| 1 | A4500/A105 | 2.4 | (6.5) | 3.1 | (20.0) | 9.1 | (12.5/6.5) | 116 |
| 2 | A4514/A120 | 0.5 | (2.0) | 3.9 | (21.6) | 6.4 | (17.3/2.2) | 51 |
| 3 | A4514/XAMA-7 | 2.0 | (1.0) | 2.4 | (21.2) | 7.4 | (24.7/1.0) | 130 |
| 4 | A4514/Kymene 557 | 3.3 | (0.8) | 2.4 | (21.2) | 8.0 | (24.5/0.7) | 96 |
| 5 | A4514/PEI | 1.4 | (3.0) | 2.0 | (11.4) | 7.3 | (11.6/2.5) | 195 |
| 6 | Ethylene-acrylic acid copolymer/PEI | 1.4 | (3.0) | 2.4 | (10.8) | 5.9 | (10.6/2.5) | 88 |
| 7 | Ethylene-acrylic acid copolymer/XAMA-7 | 2.3 | (0.9) | 2.3 | (9.5) | 10.3 | (10.8/0.7) | 248 |
| 8 | PVC/XAMA-7 | 1.7 | (1.8) | 3.0 | (10.7) | 4.9 | (11.1/1.8) | 7 |
| 9 | SB/XAMA-7 | 1.7 | (1.8) | 4.2 | (10.9) | 6.4 | (11.1/1.8) | 12 |
| 10 | A4500/polydiallylamine | 1.6 | (3.5) | 1.6 | (11.5) | 5.3 | (12.6/3.4) | 131 |
| 11 | A4500/PEI | 1.5 | (0.9) | 1.6 | (11.5) | 4.6 | (13.3/0.8) | 94 |
| 12 | PVDC/PEI | 1.5 | (0.9) | 1.8 | (12.3) | 7.4 | (14.1/0.9) | 230 |
| 13 | A4500/PPI | 2.0 | (4.0) | 1.6 | (11.5) | 6.8 | (13.6/3.7) | 200 |
| 14 | Acrylate Copolymer/PDMAEM | 0.4 | (2.3) | 1.3 | (11.0) | 2.2 | (14.3/1.8) | 38 |
| 15 | Acrylate Copolymer/ polydiallylamine | 1.6 | (2.3) | 1.3 | (11.0) | 4.7 | (13.9/1.9) | 138 |
| 16 | Acrylate Copolymer/XAMA-7 | 2.7 | (1.0) | 1.3 | (11.0) | 7.8 | (13.5/0.9) | 292 |
| 17 | Acrysol ASE108/Kymene 557 | 3.4 | (1.3) | 0.4 | (12.4) | 8.6 | (12.5/1.4) | 1200 |
| 18 | Alcogum L-35/Kymene 557 | 3.4 | (1.3) | 0.5 | (11.2) | 10.4 | (13.5/2.0) | 1300 |
| 19 | Haloflex 202/Kymene 557 | 3.4 | (1.3) | 2.1 | (18.6) | 8.9 | (15.7/1.8) | 162 |
| 20 | Haloflex 202/PEI | 1.6 | (1.6) | 2.1 | (18.6) | 7.4 | (16.3/2.4) | 176 |
| 21 | Haloflex 208/Kymene 557 | 3.4 | (1.3) | 1.8 | (17.1) | 11.3 | (16.1/1.6) | 338 |
| 22 | Haloflex 208/PEI | 1.6 | (1.6) | 1.8 | (17.1) | 8.4 | (17.2/2.1) | 277 |
| 23 | A4500/Rhoplex HA-8 | 2.8 | (4.6) | 2.1 | (11.0) | 5.7 | (10.6/4.5) | 38 |
| 24 | A4500/Hycar 2600X347 | 1.9 | (4.3) | 2.1 | (11.0) | 4.8 | (10.6/4.3) | 38 |
| 25 | Acrylate Copolymer/A105 | 2.2 | (5.0) | 1.4 | (15.7) | 6.9 | (14.5/5.0) | 236 |
| 26 | A4514/VAE-ABDA | 1.6 | (2.5) | 2.0 | (10.7) | 5.5 | (10.4/2.6) | 95 |
| 27 | PVOH-EVCl/Fibrabon 33 | 3.3 | (1.7) | 2.3 | (11.4) | 6.3 | (12.2/1.8) | 30 |
| 28 | PVOH-EVCl/Fibrabon 35 | 3.0 | (1.7) | 2.3 | (11.4) | 6.5 | (12.4/1.7) | 52 |
| | Ethylene-acrylic acid co- | | | | | | | |

TABLE I-continued

| RUN | BINDER/PRETREATMENT* | WET TENSILE STRENGTH (pli) PRETREATMENT ALONE | (wt %) | BINDER ALONE | (wt %) | BINDER/PRETREATMENT (wt %/wt %) | | PERCENT IMPROVEMENT |
|---|---|---|---|---|---|---|---|---|
| 29 | polymer/polyvinyl amine | 2.9 | (2.8) | 2.4 | (10.7) | 7.9 | (10.7/2.8) | 108 |
| 30 | PVOH-EVCl/A105 | 1.5 | (4.8) | 2.7 | (10.9) | 6.4 | (10.0/4.7) | 81 |

* See Table XII for identification of the pretreatment agents and binder polymers.

As can be seen from the data in Table I, the surprising improvement in wet tensile strength through the use of the method according to the invention was very significant in many cases. For example, Runs 7, 12, 13, 16, 17, 18, 21, 22 and 25 show improvements of 200% or more. Interestingly, the percent improvement in wet tensile strength using a particular pretreatment agent is very dependent upon the particular polymer binder employed as the overcoat. For instance, using XAMA-7 polyfunctional aziridine compound as the pretreatment agent and applying thereto polyvinyl chloride and styrene-butadiene polymer binders in Runs 8 and 9 afforded relatively small improvements of 7 and 12%, respectively. However, when Airflex 4514 ethylene-vinyl chloride (EVCl) emulsion copolymer, ethylene-acrylic acid copolymer, and acrylate compolymer were used over the XAMA-7 aziridine compound in Runs 3, 7 and 16, the wet tensile strengths showed improvements of 130, 240 and 292%, respectively.

Similarly, when polyethylenimine was the pretreatment agent, the use of ethylene-acrylic acid copolymer and Airflex 4500 EVCl copolymer as the overcoat in Runs 6 and 11, respectively, resulted in about a 90% improvement in wet strength, and more surprisingly the use of Airflex 4514 EVCL copolymer and polyvinylidene chloride copolymer as the overcoat in Runs 5 and 12 afforded about a 200% improvement.

With Kymene 557 poly(aminoamide)-epichlorohydrin resin as the pretreatment agent the improvement in wet tensile strength with various binder polymers ranged from 96% (Run 4) to over 1000% (Runs 17 and 18).

EXAMPLE 2

When the binder/pretreatment combination used in Run 11, namely Airflex 4500 EVCl copolymer/polyethylenimine, was applied to an air-laid substrate of cellulosic fibers (Run 31), a dramatic improvement in wet tensile strength of about 350% was obtained as shown in Table II.

TABLE II

| RUN | BINDER/PRETREATMENT | WET TENSILE STRENGTH (pli) PRETREATMENT ALONE | (wt %) | BINDER ALONE | (wt %) | BINDER/PRETREATMENT (wt %/wt %) | | PERCENT IMPROVEMENT |
|---|---|---|---|---|---|---|---|---|
| 31 | A4500/PEI | 40 | (3.0) | 83 | (19.3) | 419 | (21.3/3.1) | 356 |

EXAMPLE 3

Runs 32 and 33 (Table III) demonstrate the need to use an interactive (synergistic) binder/pretreatment agent system according to the invention. An interactive system is a pretreating agent which demonstrates good adhesion to the cellulosic fibers (adhesion of at least 200 g in the cellophane laminate test) and an overcoat binder which demonstrates relatively weak adhesion to the cellulosic fibers but good chemical resistance. Non-synergistic systems are binder/pretreatment agent systems in which both components demonstrate good adhesion to the cellulosic fibers, combinations in which the pretreatment agent has relatively weak adhesion to the cellulosic fibers, or combinations in which the binder has poor chemical (water and solvent) resistance.

TABLE III

| RUN | BINDER/PRETREATMENT | WET TENSILE STRENGTH (pli) PRETREATMENT ALONE | (wt %) | BINDER ALONE | (wt %) | BINDER/PRETREATMENT (wt %/wt %) | | PERCENT IMPROVEMENT |
|---|---|---|---|---|---|---|---|---|
| 32 | A105/Kymene 557 | 2.8 | (0.9) | 7.4 | (10.2) | 7.7 | (11.2/1.0) | −34 |
| 33 | A105/A4500 | 2.9 | (10.9) | 6.5 | (10.9) | 5.9 | (10.3/11.6) | −54 |
| 1 | A4500/A105 | 2.4 | (6.5) | 3.1 | (20.0) | 9.1 | (12.5/6.5) | 116 |

It can be seen from the data in Table III that the non-synergistic Airflex 105 VAE-NMA copolymer/Kymene 557 poly(aminoamide)-epichlorohydrin resin sytem was weaker, i.e. showed a decrease in wet tensile strength, than the sum of the individual components would suggest. In this case, both Airflex 105 copolymer and the Kymene 557 resin have good fiber adhesion as indicated by the cellophane laminate data in Table IV and there would be no advantage to employing a pretreatment step.

In Run 33 the cellulosic fiber were pretreated with a poor cellulosic fiber adhesive based upon cellophane laminate data (Airflex 4500 EVCl copolymer) impairing the strength of a VAE/NMA copolymer binder which itself has good adhesion based upon cellophane laminate data (Airflex 105 emulsion copolymer). In Run 33 there was a decrease of about 50% in wet tensile strength. Thus, in this combined system, the binder/pretreatment system was weaker than the binder alone. Again it can be seen from the data for Run 1 in Table III that applying the two copolymers used in Run 33 to the cellulosic fibers in reverse order, i.e in accordance with the invention, provides over 100% improvement in wet strength.

TABLE IV

| Cellophane Laminate Test Data | 180° Peel Adhesion (grams) | |
|---|---|---|
| Polymer | plasticized | unplasticized |
| A105 | 230 | 614 |
| Rhoplex Ha-8 | 1000 | 452 |
| XAMA-7 | | tore film |
| Kymene 557 | | tore film |
| PVDC | no bond | no bond |
| Acrylate Copolymer | 161 | 290 |
| PVOH | no bond | |
| Ethylene-Acrylic acid copolymer | no bond | no bond |
| A4500 | 80 | |
| Polyvinylpyrrolidinone | 180 | |
| Agefloc WT-40 | no bond | |

Table IV shows cellophane laminate test data for a number of materials. XAMA-7 polyfunctional aziridine compound and Kymene 557 poly(aminoamide)-epichlorohydrin resin did not dry when sandwiched between plasticized cellophane films. Between unplasticized cellophane films the materials dried and, when tested, demonstrated such a strong adhesion that the cellophane films tore.

Table V shows binder criteria data which indicates the Acrysol ASE 108 acrylic copolymer. Airflex 4500 ethylene-vinyl chloride copolymer, acrylate copolymer and ethylene-acrylic acid polymer are suitable as overcoat polymer binders.

TABLE V

| BINDER CRITERIA | | | Whatman Paper | |
|---|---|---|---|---|
| Polymer | Boiling Water Swell, % | MEK Swell Index | Tensile Strength Wet | pli (wt % add-on) MEK |
| Acrysol ASE 108 | 80 | 3.5 | 0.4 (12.4) | 7.8 (11.7) |
| Hycar 2600X347 | 15 | 2.8 | 5.4 (11.0) | 5.4 (11.0) |
| Vinol 205 | dissolved | 1 | 0.1 (7.8) | 9.9 (7.7) |
| A4500 | 10 | 14 | 1.6 (11.5) | 2.4 (11.7) |
| A105 | 30 | 4 | 7.4 (10.2) | 8.0 (10.0) |
| Acrylate Copolymer | 30 | 11 | 1.3 (11.0) | 2.2 (10.9) |
| Ethylene-Acrylic | | | | |

TABLE V-continued

| BINDER CRITERIA | | | Whatman Paper | |
|---|---|---|---|---|
| Polymer | Boiling Water Swell, % | MEK Swell Index | Tensile Strength Wet | pli (wt % add-on) MEK |
| Acid Copolymer | 60 | 1 | 2.4 (10.7) | 3.4 (10.4) |
| Rhoplex HA-8 | 22 | 3 | 6.1 (10.5) | 6.1 (10.5) |

Other non-interactive systems are shown in Tables VI and VII. It can be seen from Runs 34–39 that the binder must have good chemial resistance if the adhesion promoting treatment is to be used to advantage. Table V shows that Airflex 4500 emulsion copolymer and the acrylate copolymer lack resistance to MEK as measured by the swell test. Thus there is no benefit in MEK tensile strength when polyethyleneinimine (PEI), Airflex 105 emulsion copolymer or the polyfunctional aziridine compound (XAMA-7) pretreatments are used with these binders (Runs 40–42). However, because Airflex 4500 emulsion copolymer and the acrylate copolymer have good water resistance, as measured by the boiling water swell test, their wet tensile strength does improve with the use of pretreatments (see Runs 11 and 16). Accordingly, a binder/pretreatment combination may be non-interactive with respect to water resistance but interactive with respect to solvent resistance or vice versa.

TABLE VI

| | | WET TENSILE STRENGTH (pli) | | | | | | |
|---|---|---|---|---|---|---|---|---|
| RUN | BINDER/PRETREATMENT | PRETREATMENT ALONE (wt %) | | BINDER ALONE (wt %) | | BINDER/PRETREATMENT (wt %/wt %) | | PERCENT IMPROVEMENT |
| 34 | Hycar 2600X347/Kymene 557 | 3.4 | (1.3) | 4.3 | (10.8) | 7.5 | (13.0/1.4) | −5 |
| 35 | Rhoplex Ha-8/A105 | 4.0 | (7.0) | 6.1 | (10.5) | 9.7 | (11.5/7.1) | −7 |
| 36 | A4500/Vinol 205 | 0.2 | (2.4) | 1.6 | (11.5) | 1.7 | (9.9/2.1) | negative |
| 37 | A4500/PVP | 0.06 | (3.2) | 1.6 | (11.5) | 1.1 | (9.5/3.5) | negative |
| 38 | A4500/Agefloc WT-40 | 0.2 | (4.1) | 1.6 | (11.5) | 1.1 | (14.5/3.9) | negative |
| 39 | Vinol 205/VAE-ABDA | 4.9 | (4.6) | 0.1 | (7.8) | 5.1 | (7.7/4.8) | negative |

TABLE VII

| | | MEK TENSILE STRENGTH (pli) | | | | | |
|---|---|---|---|---|---|---|---|
| RUN | BINDER/PRETREATMENT | PRETREATMENT ALONE (wt %) | | BINDER ALONE (wt %) | | BINDER/PRETREATMENT (wt %/wt %) | |
| 40 | A4500/PEI | 5.9 | (1.0) | 2.5 | (11.5) | 5.9 | (13.8/0.8) |
| 41 | Acrylate Copolymer/A105 | 3.9 | (5.2) | 2.5 | (15.9) | 4.8 | (14.9/5.2) |
| 42 | Acrylate Copolymer/XAMA-7 | 5.9 | (1.1) | 2.2 | (10.9) | 7.5 | (13.9/1.0) |

EXAMPLE 4

This Example suggests that the adhesion between the binder and the pretreatment agent is due to a physical interaction rather than actual covalent bond formation. Airflex 105 VAE/NMA copolymer and Airflex 4500 EVC1 copolymer can covalently bond through the reaction of the N-methylolacrylamide in the former with the acrylamide in the latter. To prevent this reaction, which is acid catalyzed, the Airflex 105 copolymer pretreatment was made alkaline with sodium hydroxide. It can be seen from the data in Table VIII that under these conditions (Runs 43 and 44), performance was not impaired, implying that covalent bond formation is not a necessary condition for obtaining this synergistic effect.

TABLE VIII

| RUN | BINDER/PRETREATMENT | WET TENSILE STRENGTH (pli) PRETREATMENT ALONE (wt %) | | BINDER ALONE (wt %) | | BINDER/PRETREATMENT (wt %/wt %) | | PERCENT IMPROVEMENT |
|---|---|---|---|---|---|---|---|---|
| 43 | A4500/A105 | 0.4 | (5.3) | 2.5 | (15.2) | 6.8 | (13.6/5.4) | 156 |
| 44 | A4500/A105 with NaOH to pH 8 | 0.4 | (5.3) | 2.5 | (15.2) | 7.0 | (13.4/5.2) | 184 |

EXAMPLE 5

This Example indicates how the present invention may be used to obtain formaldehyde-free nonwoven products having good wet tensile strength. In Runs 45–47 both the copolymer binder and the pretreatment agent are formaldehyde-free, but only when used in the binder/pretreatment method in accordance with the invention do these polymers yield good wet tensile strength as shown by the data in Table IX.

TABLE IX

| RUN | BINDER/PRETREATMENT | WET TENSILE STRENGTH (pli) PRETREATMENT ALONE (wt %) | | BINDER ALONE (wt %) | | BINDER/PRETREATMENT (wt %/wt %) | | PERCENT IMPROVEMENT |
|---|---|---|---|---|---|---|---|---|
| 45 | BA-VCl/Kymene 557 | 2.8 | (0.9) | 1.4 | (10.7) | 4.7 | (10.7/0.9) | 36 |
| 46 | PVOH-EVCl/Kymene 557 | 2.6 | (1.1) | 2.1 | (10.2) | 5.4 | (11.2/1.1) | 33 |
| 47 | PVOH-EVCl/PEI | 1.8 | (2.4) | 2.1 | (10.2) | 6.5 | (10.7/2.4) | 124 |

EXAMPLE 6

Table X shows the solvent resistance for the binder/-pretreatment systems of Runs 48 and 49 according to the invention. It is evident from Table X that the present invention may be employed to obtain a nonwoven product demonstrating improved solvent resistance.

TABLE X

| RUN | BINDER/PRETREATMENT | MEK TENSILE STRENGTH (pli) PRETREATMENT ALONE (wt %) | | BINDER ALONE (wt %) | | BINDER/PRETREATMENT (wt %/wt %) | |
|---|---|---|---|---|---|---|---|
| 48 | Ethylene-acrylic acid Copolymer/XAMA-7 | 4.3 | (0.8) | 3.7 | (20) | 10.5 | (20/0.8) |
| 49 | Ethylene-acrylic acid Copolymer/PEI | 5.2 | (3.0) | 3.2 | (10.6) | 11.5 | (10.8/3.1) |

EXAMPLE 7

This example demonstrates that the present invention is applicable to other cellulosic fibers such as rayon as can be seen from the data in Table XI.

TABLE XI

| RUN | BINDER/PRETREATMENT | Performance On Rayon WET TENSILE STRENGTH (gli) PRETREATMENT ALONE (wt %) | | BINDER ALONE (wt %) | | BINDER/PRETREATMENT (wt %/wt %) | | PERCENT IMPROVEMENT |
|---|---|---|---|---|---|---|---|---|
| 50 | A4500/PEI | 0<br>13 | (3.3)<br>(13.8) | 57.4 | (28.1) | 89.8 | (20.2/5.8) | 56 |
| 51 | A4500/Kymene 557 | 0<br>19 | (4.2)<br>(12.9) | 57.4 | (28.1) | 161.7 | (19.7/4.8) | 182 |

TABLE XII

IDENTIFICATION OF PRETREATMENT AGENTS AND BINDER POLYMERS

| | |
|---|---|
| PEI | polyethyleneimine |
| PPI | polypropyleneimine |
| XAMA-7 | a polyfunctional aziridine compound (Cordova Chemical) |
| PDMAEM | polydimethylaminoethylmethacrylate |
| Kymene 557 | a poly(aminoamide)-epichlorohydrin resin (Hercules Corp.) |
| Airflex 120 | VAE/NMA, tg −20° C. (Air Products and Chemicals, Inc.) |
| Airflex 105 | VAE/NMA, tg 0° C. (Air Products and Chemicals, Inc.) |
| Rhoplex HA-8 | acrylic copolymer (Rohm & Haas) |
| Fibrabon 33 | wet strength agent (Diamond Shamrock) FVD |
| Fibrabon 35 | wet strength agent (Diamond Shanrock) FVD |
| Vinol 205 | polyvinyl alcohol (Air Products and Chemicals, Inc.) |
| Agefloc WT-40 | cationic aminoacrylate (CPS Chemical) |
| PVP | polyvinyl pyrrolidone |
| VAE-ABDA | vinyl acetate-ethylene-acrylamidobutyraldehyde diethyl acetal copolymer |
| Airflex 4500 | ethylene-vinyl chloride copolymer, Tg of 0° C. (Air Products and Chemicals, Inc.) |
| Airflex 4514 | ethylene-vinyl chloride copolymer, Tg of +14° C. (Air products and Chemicals, Inc.) |
| PVC | polyvinyl chloride |

TABLE XII-continued

| IDENTIFICATION OF PRETREATMENT AGENTS AND BINDER POLYMERS | |
|---|---|
| SB | styrene-butadiene copolymer |
| PVDC | polyvinylidene chloride copolymer |
| Acrysol ASE108 | acrylic copolymer (Rohm & Haas) |
| Alcogum L-35 | acrylic copolymer (Alco Chemical) |
| Haloflex 202 | butylacrylate-vinylidene chloride copolymer (ICI Corp.) |
| Haloflex 208 | butylacrylate-vinylidene chloride copolymer (ICI Corp.) |
| PVOH-EVCl | ethylene-vinyl chloride copolymer, PVOH stabilized |
| BA-VCl | butylacrylate-vinyl chloride copolymer |
| Hycar 2600 X347 | acrylic copolymer (Goodrich) |

STATEMENT OF INDUSTRIAL APPLICATION

Cellulosic nonwoven products, such as paper towels, industrial wipes, protective garments, medical/surgical materials, filters and the like, of enhanced wet and/or solvent strength can be obtained using the binder/pretreatment agent process of the invention.

I claim:

1. In a method for bonding a nonwoven web of cellulosic fibers by depositing a polymeric binder on the web, the improvement comprising (1) pretreating the cellulosic fibers by depositing up to about 10 wt% of an adhesion-promoting compound which demonstrates adhesion to cellulose of at least 200 g as measured by the cellophane laminate test, (2) forming the fibers into a nonwoven web if not already in such form and drying the web, and (3) depositing on the dry nonwoven web of pretreated cellulosic fibers an amount of a binder polymer sufficient to provide a bonded self-sustaining web which binder polymer demonstrates wet tensile strength on Whatman #4 filter papers at 10% add-on (TAPPI Useful Method 656) of less than 3 pli and a swell value of less than 100% using the boiling water test, or a MEK tensile strength on Whatman #4 filter paper at 10% add-on (TAPPI Useful Method 656) of less than 4 pli and and MEK swell index of less than 5.

2. The method of claim 1 in which 0.1–5 wt% of an adhesive promoting compound, based on fiber weight, is deposited on the cellulosic fibers.

3. The method of claim 1 in which the adhesion promoting compound demonstrates adhesion to cellulosic fibers of at least 400 g.

4. The method of claim 1 in which 3–100 wt% of a binder polymer, based on fiber weight, is deposited on the pretrated cellulosic fibers.

5. The method of claim 1 in which 5–50 wt% of a binder polymer, based on fiber weight, is deposited on the pretreated cellulosic fibers.

6. The method of claim 1 in which the adhesion promiting compound is selected from the group consisting of polyethylenimines, polypropylenimines, polyfunctional aziridine compounds, poly(aminoamide)-epichlorohydrin resins, polydiallylamines, vinyl acetate-ethylene-N-methylolacrylamide copolymers, polydimethylaminoethylmethacrylate, acrylic copolymers, and polyvinylamines.

7. The method of claim 1 in which the binder polymer is selected from the group consisting of ethylene-vinyl chloride-acrylamide polymers, ethylene-acrylic acid copolymers, vinylidene chloride copolymers, ethylacrylate-vinyl acetate-methacrylic acid copolymers, vinyl chloride-butyacrylate copolymers, polyneoprenes, butadiene-acrylonitrile copolymers, polyurethanes, styrene-acrylate copolymers, vinyl acetate-acrylate copolymers and vinyl chloride-acrylate copolymers.

8. The method claim 1 in which the binder polymer demonstrates a wet tensile strength of less than 2.5 pli and a swell value index of less than 50% using the boiling water test, or an MEK tensile strength of less than 3 pli and an MEK swell index of less than 3.

9. The method of claim 3 in which the binder polymer demonstrates a wet tensile strength of less than 2.5 pli and a swell value index of less than 50% using the boiling water test, or an MEK tensile strength of less than 3 pli and an MEK swell index of less than 3.

10. The method of claim 1 in which the binder polymer/adhesive promoting compound combinations are selected from the group consisting of ethylene-vinyl chloride copolymer/polyethyleneimine, ethylene-acrylic acid copolymer/polyfunctional aziridine compound, polyvinylidene chloride copolymer/polyethyleneimine, ethylene-vinyl chloride copolymer/polypropyleneimine, acrylate copolymer/polyfunctional aziridine compound, acrylic copolymer/poly(aminoamide)-epichlorohydride resin, butylacrylatevinylidene chloride copolymer/poly(aminoamide)-epichlorohydrin resin, butylacrylate-vinylidene chloride copolymer/polyethyleneimine, and acrylate copolymer/vinyl acetate-ethylene-N-methylolacrylamide copolymer.

11. A nonwoven product comprising a nonwoven web of cellulosic fibers bonded together, the cellulosic fibers having as a first coat up to 10 wt% of an adhesion-promoting compound which demonstrates adhesion to cellulose of at least 200 g as measured by the cellophane laminate test and as an overcoat an amount of a binder polymer sufficient to form a bonded self-sustaining web which binder polymer demonstrates wet tensile strength on Whatman #4 filter paper at 10% add-on (TAPPI Useful Method 656) of less than 3 pli and a swell value of less than 100% using the boiling water test, or an MEK tensile strength on Whatman #4 filter paper at 10% add-on (TAPPI Useful Method 656) of less than 4 pli and an MEK swell index of less than 5.

12. The nonwoven product of claim 11 in which the adhesion promoting compound is present at 0.1–5 wt%, based on fiber weight.

13. The nonwoven product of claim 11 in which the adhesion promoting compound demonstrates adhesion to the cellulosic fibers of at least 400 g.

14. The nonwoven product of claim 11 in which the binder polymer is present at 3–100 wt%, based on fiber weight.

15. The nonwoven product of claim 11 in which the binder polymer is present at 5–50 wt%, based on fiber weight.

16. The nonwoven product of claim 11 in which the adhesion promoting compound is selected from the group consisting of polyethyleneimines, polypropylenimines, polyfunctional aziridine compounds, poly(aminoamide)-epichlorohydrin resins, polydiallylamines, vinyl acetate-ethylene-N-methylolacrylamide copolymers, polydimethylaminoethylmethacrylate, acylic copolymers, and polyvinylamines.

17. The nonwoven product of claim 11 in which the binder polymer is selected from the group consisting of ethylene-vinyl chloride-acrylamide polymers, ethylene-acrylic acid copolymers, vinylidene chloride copolymers, ethyacrylate-vinyl acetate-methacrylic acid copolymers, vinyl chloride-butylacrylate copolymers, polyneoprenes, butadiene-acrylonitrile copolymers, polyurethanes, styrene-acrylate copolymers, vinyl acetate-acrylate copolymers and vinyl chloride-acrylate copolymers.

18. The nonwoven product of claim 11 in which the binder polymer demonstrates wet tensile strength of less than 2.5 pli and a swell value of less than 50% using the boiling water test, or an MEK tensile strength of less than 3 pli and an MEK swell index of less than 3.

19. The nonwoven product of claim 13 in which the binder polymer demonstrates wet tensile strength of less than 2.5 pli and a swell value of less than 50% using the boiling water test, or an MEK tensile strength of less than 3 pli and an MEK swell index of less than 3.

20. The nonwoven product of claim 11 in which the binder polymer/adhesion promoting compound combinations are selected from the group consisting of ethylene-vinyl chloride copolymer/polyethyleneimine, ethylene-acrylic acid copolymer/polyfunctional aziridine compound, polyvinylidene chloride copolymer/-polyethyleneimine, ethylene-vinyl chloride copolymer/polypropyleneimine, acrylate copolymer/-polyfunctional aziridine compound, acrylic copolymer/poly(aminoamide)-epichlorohydrin resin, butylacrylate-vinylidene chloride copolymer/-poly(aminoamide)-epichlorohydrin resin, butylacrylate-vinylidene chloride copolymer/polyethyleneimine, and acrylate copolymer/vinyl acetate-ethylene-N-methylolacrylamide copolymer.

* * * * *